US005283164A

United States Patent [19]

Fenton et al.

[11] Patent Number: 5,283,164

[45] Date of Patent: Feb. 1, 1994

[54] COLOR FILM WITH CLOSELY MATCHED ACUTANCE BETWEEN DIFFERENT COLOR RECORDS

[75] Inventors: David E. Fenton; John F. Sawyer, both of Fairport; Donald H. Hunger, Hilton, all of N.Y.

[73] Assignee: Eastman Kodak Company, Rochester, N.Y.

[21] Appl. No.: 901,605

[22] Filed: Jun. 19, 1992

[51] Int. Cl.[5] ..... G03C 1/46

[52] U.S. Cl. ..... 430/506; 430/504; 430/507; 430/509; 430/934

[58] Field of Search ..... 430/506, 504, 507, 509, 430/934

[56] References Cited

U.S. PATENT DOCUMENTS

| | | | |
|---|---|---|---|
| 3,948,663 | 4/1976 | Shiba et al. | 430/505 |
| 3,984,246 | 10/1976 | Ohlschlager et al. | 430/522 |
| 4,105,453 | 8/1978 | Numata et al. | 430/559 |
| 4,461,826 | 7/1984 | Yamashita et al. | 430/505 |
| 4,707,435 | 11/1987 | Lyons et al. | 430/507 |
| 4,724,197 | 2/1988 | Matejec et al. | 430/377 |
| 4,806,461 | 2/1989 | Ikeda et al. | 430/567 |
| 4,855,220 | 8/1989 | Szajewski | 430/505 |
| 4,939,078 | 7/1990 | Kuramoto et al. | 430/506 |
| 4,952,485 | 8/1990 | Shibahara et al. | 430/502 |
| 4,963,465 | 10/1990 | Matejec et al. | 430/506 |
| 4,975,359 | 12/1990 | Sasaki et al. | 430/509 |

FOREIGN PATENT DOCUMENTS

| | | | |
|---|---|---|---|
| 0606288 | 10/1960 | Canada | 430/507 |
| 0306246 | 8/1988 | European Pat. Off. . | |
| 0368275 | 11/1989 | European Pat. Off. . | |
| 60-17737 | 1/1985 | Japan . | |

OTHER PUBLICATIONS

James, T. H., "The Theory of the Photographic Process", Fourth Edition, Chapter 21, Image Structure, pp. 592–635, Macmillan Pub. Co. Inc. 1977.

English language Abstract of Japanese Publication JP 3004222, published Jan. 1991.

English language Abstract of Japanese Publication JP 1046744, published Feb. 1989.

English language Abstract of Japanese Publication JP 63184749 published Jul. 1988.

English language Abstract of Japanese Publication JP 62195656, published Aug. 1987.

English language Abstract of Japanese Publication JP 62025756, published Feb. 1987.

English language Abstract of Japanese Publication JP 62010650, published Jan. 1987.

English language Abstract of Japanese Publication JP 61169843, published Jan. 1987.

*Primary Examiner*—Charles L. Bowers, Jr.
*Assistant Examiner*—Thomas R. Neville
*Attorney, Agent, or Firm*—Gordon M. Stewart

[57] ABSTRACT

A color photographic silver halide negative working duplicating element comprising a support bearing, in order from the support, at least one red-sensitive photographic silver halide emulsion layer package comprising at least one cyan image-dye forming coupler that is capable upon exposure and processing of forming a cyan image dye that absorbs in the range of the original image; at least one green-sensitive photographic silver halide emulsion layer package comprising at least one magenta image-dye forming coupler that is capable, upon exposure and processing, of forming a magenta image dye that absorbs in the range of the original image; and at least one blue-sensitive photographic silver halide emulsion layer package comprising at least one yellow image-dye forming coupler that is capable upon exposure and processing of forming a yellow image dye that absorbs in the range of the original image. The silver halide particles in the fastest blue sensitive layer have an equivalent spherical diameter no greater than 0.3 microns, while in the remainder of the layers the silver halide particles have an equivalent spherical diameter of no greater than 0.23 microns. The silver level in the fastest blue sensitive layer is no greater than 30 mg/square foot. A sufficient red absorber is present so that the red record MTF(12) is at least 95% of the green record MTF(12) and the red record F50 is no more than 6/mm less than the green record F50.

14 Claims, No Drawings

COLOR FILM WITH CLOSELY MATCHED ACUTANCE BETWEEN DIFFERENT COLOR RECORDS

FIELD OF THE INVENTION

This invention relates to a color negative duplicating film in which the red and green records in particular, have closely matched acutance.

BACKGROUND OF THE INVENTION

Color photographic silver halide negative working duplicating elements, especially films, have been known, especially for duplicating color motion picture films. A typical example of such a duplicating element is Eastman Color Intermediate Film manufactured and sold by Eastman Kodak Company, U.S.A. Such a duplicating element is useful in preparing duplicates of motion picture film. The usual construction of such element is to have three records, each record having one or more layers containing emulsions sensitive to different regions of the spectrum, namely the red, green and blue light sensitive layers. Those layers contain color forming compounds which produce cyan, magenta and yellow dyes, respectively, in accordance with the amount of light of red, green and blue colors to which the film is exposed. The records are arranged with the red record lowest (that is, furthest from the light source when the film is exposed in a normal manner), followed by the green record above the red record and the blue record above the green record.

Current practice for most color motion picture production involves the use of at least four photographic steps. The first step is the recording of the scene onto a camera negative photographic film. For applications using two steps this original negative is printed onto a negative working print film, producing a direct print. Most motion picture productions use an additional two steps. The original camera negative film is printed onto a negative working intermediate film, such as the described Eastman Color Intermediate Film, yielding a master positive. The master positive is subsequently printed again onto an intermediate film providing a duplicate negative. Finally, the duplicate negative is printed onto a print film forming the release print. In certain situations, usually involving special effects, the intermediate film may be used four times. In this case, the produced master positive is used to produce a first duplicate negative which is then used to produce a second master positive, which is in turn used to produce a second duplicate negative. The second duplicate negative is used for printing the release print.

Given the number of copies which are made sequentially from the intermediate film it is desirable that the intermediate film produce a negative that enables a print with a minimum degradation in tone scale, color, graininess, and sharpness when compared to the direct print. A known sharpness measurement is acutance. Any sharpness loss (that is, loss in acutance) in the intermediate film will be increased dramatically due to the sequential copying using the intermediate film, as described. Thus, an unacceptable lowering of acutance in the release print as compared to the direct print (which is the most appropriate comparison), may result. Ideally, the intermediate film would produce no degradation of sharpness. In practice, there has always been some sharpness degradation which results in considerable sharpness loss in the sequential copying process described above to produce the release print.

SUMMARY OF THE INVENTION

It has been discovered that a significant cause of loss of sharpness in the color negative intermediate film as a whole, is as a result of unequal loss of sharpness in each of the three colored layer sets. In particular, the acutance of the bottom layer in a three color film has always been lower than that of the other two records. This lower acutance of the bottom record occurs because of the light scattering properties of the emulsions in the layers above. Existing intermediate films have the red record on the bottom followed by the green record then the blue record being above the other two records. In particular, the red record, which is typically lowest of the red, green and blue records, tends to suffer the greatest sharpness loss. As a result, when an intermediate film is used to produce release prints, the higher loss of sharpness in the red record becomes highly emphasized during the making of multiple sequential copies to produce the release print. This can cause the resulting release print to exhibit color smudging. It has been discovered that the foregoing loss of sharpness and smudging of the color film as a whole, can be reduced by more closely matching the sharpness loss in the layers (that is, by more closely matching the acutance of the layers). At the same time, excessive sharpness loss in any of the three layer sets can be avoided.

It has been discovered that in a film containing the red, green and blue records in the order described above (that is, red record lowest), that the acutance of the red layer can be markedly increased to a level closer to that of the green record acutance with each layer still having high acutance and without excessive speed loss, by controlling three variables within certain parameters. These variables are the silver halide particle size of the fastest blue sensitive layer (normally having the largest silver halide particles of all the layers), the silver laydown (sometimes referred to as silver "level" in this application) of the fastest blue-sensitive layer, and the levels of green and red absorbers present (note that a green or red absorbing dye would be colored magenta and cyan, respectively). Preferably, the red record acutance is "closely matched" (as defined later) to that of the green record. In particular, a closer matching of acutance is obtained in a such a film, preferably a color negative duplicating film, when all of the following conditions are satisfied:

1) the silver halide particles in the fastest blue sensitive layer have an equivalent spherical diameter no greater than 0.3 microns, while in the remainder of the layers the silver halide particles have an equivalent spherical diameter of no greater than 0.23 microns;

2) the silver level in the fastest blue sensitive layer is no greater than 30 mg/square foot; and 3) a sufficient red absorber is present so that the red record MTF(12) is at least 95% of the green record MTF(12) and the red record F50 is no more than 6 cycles/mm less than the green record F50. The percentage figures used in this application in comparing MTF(12) values of the red and green absorbers are relative values, thus when it is stated that the red record MTF(12) is at least 95% of the green record MTF(12), this means that the red MTF(12) has a value which is 95% of the value of the green record MTF(12). Likewise, when the red record MTF(12) is stated to be within 5% of the green record MTF(12), this means within the red record MTF(12) has a value within 5% of the green record MTF(12).

In addition, it is preferred that the red record have an MTF(12) of at least 90% (and more preferably at least 93%) and an F50 of at least 45 cycles/mm (and preferably at least 50 cycles/mm).

DETAILED DESCRIPTION OF EMBODIMENTS OF THE INVENTION

The color photographic elements preferably have a red record MTF(12) is within 5% (more preferably within 3%) of the green record MTF(12) and the red record F50 is within 6 cycles/mm (more preferably within 3 cycles/mm) of the green record F50. Further, the fastest blue layer of the element may preferably have a silver level of no greater than 15 mg/square foot. The emulsion may comprise primarily cubic silver halide grains, and preferably the grains are non-tabular (including cubic) silver halide grains.

The first two of the above three factors (that is, silver halide particle size and laydown of fastest blue sensitive layer) is important to control since in all current examples of intermediate films, the fastest blue sensitive layer has the largest silver halide particles of all the light sensitive layers and therefore is typically the most light scattering. Since the fastest blue emulsion causes the most light scattering, the laydown (that is, the amount of silver halide particles) of the emulsion is also important to control. The third parameter described (the amount of absorbers) is important to control since the absorbers absorb and reduce scattered green and red light before they can reach their corresponding light sensitive records. This is particularly important for a red absorber since the red light will tend to be scattered the most when it reaches its corresponding light sensitive record. On the other hand, it is desirable to keep use of light absorbers low since they will typically reduce sensitivity.

The above requirements may be applied to any film (positive or negative) having red, green and blue records in the typical order described above. However, a particularly preferred application of the present invention is in negative working color duplicating film.

The silver halide used in the photographic elements of the present invention may be silver bromoiodide, silver bromide, silver chloride, silver chlorobromide, and the like, which are provided in the form of an emulsion. The photographic elements of the present invention preferably use three dimensional emulsions, that is non-tabular grain emulsions. Tabular silver halide grains are grains having two substantially parallel crystal faces that are larger than any other surface on the grain. Tabular grain emulsions are generally considered to be those in which greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains.

The grain size of the silver halide may have any distribution known to be useful in photographic compositions, and may be ether polydipersed or monodispersed, providing it meets the grain size limitations already discussed.

The silver halide grains to be used in the invention may be prepared according to methods known in the art, such as those described in *Research Disclosure*, (Kenneth Mason Publications Ltd, Emsworth, England) Item 308119, December, 1989 (hereinafter referred to as *Research Disclosure I*) and James, *The Theory of the Phogotgraphic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide to be used in the invention may be advantageously subjected to chemical sensitization with compounds such as gold sensitizers (e.g., aurous sulfide) and others known in the art. Compounds and techniques useful for chemical sensitization of silver halide are known in the art and described in *Research Disclosure I* and the references cited therein.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 5 to 8, and temperatures of from 30° to 80° C., as illustrated in *Research Disclosue*, June 1975, item 13452 and U.S. Pat. No. 3,772,031.

The silver halide may be sensitized by dyes which provide sensitivity in the red, green and blue regions of the spectrum, by any method known in the art, such as described in *Research Disclosure I*. The silver halide emulsions in the photographic elements of the present invention are sensitized with a dye having a sensitivity in the red, green or blue region. The amount of sensitizing dye that is useful is preferably in the range of 0.1 to 4.0 millimoles per mole of silver halide and more preferably from 0.2 to 2.2 millimoles per mole of silver halide. Optimum dye concentrations can be determined by methods known in the art. Known supersensitizers may also be used. The dye may be added to an emulsion of the silver halide grains and a hydrophilic colloid at any time prior to (e.g., during or after chemical sensitization) or simultaneous with the coating of the emulsion on a photographic element. The silver halide emulsion may be mixed with a dispersion of color image-forming coupler immediately before coating or in advance of coating (for example, 2 hours). Essentially any type of emulsion (e.g., negative-working emulsions such as surface-sensitive emulsions or unfogged internal latent image-forming emulsions, direct-positive emulsions such as surface fogged emulsions, or others described in, for example, *Research Disclosure I*) may be used. However, the present invention is preferably directed toward negative working emulsions.

Other addenda in the emulsion may include antifoggants, stabilizers, filter dyes, light absorbing or reflecting pigments, vehicle hardeners such as gelatin hardeners, coating aids, dye-forming couplers, and development modifiers such as development inhibitor releasing couplers, timed development inhibitor addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art and are used to counteract dye stain.

The emulsion layer containing sensitized silver halide, can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers, antistatic agents, optical brighteners, light-absorbing or light-scattering pigments, and the like. The layers of the photographic element can be coated onto a support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

As already described, color photographic elements of the present invention contain three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271 2. Dye-forming couplers are well-known in the art and are disclosed, for example, in *Research Disclosure I.*

The duplicating element can be processed by compositions and processes known in the photographic art for processing duplicating elements, especially processes and compositions known for preparation of duplicates of motion picture films. A typical example of a useful process is the ECN-2 process of Eastman Kodak Company, U.S.A. and the compositions used in such a process. Such as process and compositions for such a process are described in, for example, "Manual for Processing Eastman Color Films-H-24" available from Eastman Kodak Co. Processing to form a visible dye image includes the step of contacting the exposed element with a color developing agent to reduce developable silver halide and oxidize color developing agent. Oxidized developing agent in turn reacts with the couplers to yield dye. Any color developing agent is useful for processing the described duplicating element. Particularly useful color developing agents are described in, for example, U.S. Pat. No. 4,892,805 in column 17, the disclosure of which is incorporated herein by reference.

The invention is described further in the following examples.

EXAMPLE 1

Example 1 describes an experiment which defines the parameters established in this patent. The experiment is a 3 to the third full factorial experiment which involved 27 coatings and used variations shown in Table 1.

TABLE 1

| Parameters Varied in Factorial Experiment | Low | Medium | High |
|---|---|---|---|
| Fast Blue-Sensitive Emulsion Size* (microns) | 0.21 | 0.26 | 0.30 |
| Fast Blue-Sensitive Silver Laydowns: ($mg/m^2$) | 151 | 237 | 323 |
| Absorber Dye Levels: (mg) | | | |
| SMB: | 81 | 113 | 162 |
| ABS1: | 25.3 | 37.7 | 39.3 |

*Emulsion measured by turbidimetric techniques as described in Particle Characterization, vol. 2, pages 14–19, 1985. The measurement yields an equivalent spherical volume/turbidity mean diameter. These measurements will be described here as "equivalent spherical diameters." The cubic emulsions used in this experiment have edge lengths of 0.16, 0.20 and 0.23 microns. Particles having morphologies other than cubic will be related to this measurement by having a volume equivalent to a sphere with the diameter equal to the Esd.

SMB = sulfomethyl blue; also known as 2,6-anthracene disulfonic acid, 9,10-dihydro-1,5-dihydroxy-9,10-dioxo-4,8-bis((sulfomethyl)amino)-4 sodium.

The structure of ABS1 is given below. Both SMB and ABS1 are water soluble and therefore diffuse throughout the multi-layer structure. They also wash out during development.

The above variations were chosen for specific reasons: emulsion sizes larger than the largest size had been shown to be the source of significant light scatter; emulsions smaller than the smallest size seemed unlikely to achieve the speed required for a fast blue emulsion in this system. Fast blue silver laydowns higher than the highest level were avoided to minimize silver laydown; fast blue silver laydowns lower than the lowest level sacrificed blue layer performance (that is, with larger grains granularity increases significantly and with smaller grains speed is sacrificed). Absorber dye levels higher than the highest level sacrificed too much red-sensitive emulsion speed; absorber dyes lower than the lowest level did not provide sufficient acutance enhancement.

The above variations were coated over a partial multilayer coating consisting of a red-sensitive record, a green sensitive record and with a blue-sensitive record consisting of a mid-blue and slow blue record as follows:

A cellulose acetate film support with a back side Rem jet TM antihalation layer was coated with the indicated layers, in sequence, with Layer 1 being coated nearest the support. Note that in this Example and in Example 2, when the two red absorber dyes ABS1 and SMB were present together, they were in a ratio of ABS1 to 3SMB by weight (that is, 1/3 by weight).

Layer Arrangement

Layer 1: Slow Cyan
- 0.288 g/m² of a red sensitized cubic grain silver bromoiodide (3.5% iodide) emulsion with an edge length of 0.042 μm and chemically sensitized with sulfur and gold sensitizers.
- 0.347 g/m² of cyan image-dye forming coupler C-1.
- 0.072 g/m² of masking coupler MC-1.
- 0.031 g/m² of cyan absorber dyes ABS1 and SMB.
- 3 068 g/m² of gelatin vehicle.

Layer 2: Mid cyan
- 0.187 g/m² of a red sensitized cubic grain silver bromoiodide (3.5% iodide) emulsion with an edge length of 0.072 μm and chemically sensitized with sulfur and gold sensitizers.
- 0.161 g/;m² of cyan image-dye forming coupler C-1.
- 0.052 g/m² of masking coupler MC-1.
- 0.023 g/m² of cyan absorber dyes ABS1 and SMB.
- 0.727 g/m² of gelatin vehicle.

Layer 3: Fast cyan
- 0.220 g/m² of 50% by weight red sensitized cubic grain silver bromoiodide (3.5% iodide) emulsion with an edge length of 0.136 μm and chemically sensitized with sulfur and gold sensitizers with 50% by weight red sensitized cubic grain silver bromoiodide (3.5% iodide) emulsion with an edge length of 0.091 μm and chemically sensitized with sulfur and gold sensitizers
- 0.114 g/m² of cyan image-dye forming coupler C-1.
- 0.005 g/m² of masking coupler MC-1.
- 0.027 g/m² of cyan absorber dyes ABS1 and SMB.
- 0.807 g/m² of gelatin vehicle.

Layer 4: Interlayer
- 0.700 g/m² of gelatin vehicle.
- 0.269 g/m² of DOX-1.

Layer 5: Slow Magenta
- 0.389 g/m² of green sensitized cubic grain silver bromoiodide (3.5% iodide) emulsion with an edge length of 0.056 μm and chemically sensitized with sulfur and gold sensitizers.
- 0.329 g/m² of magenta image-dye forming coupler M-1.
- 0.104 g/m² of masking coupler MC-2.
- 0.015 g/m² of magenta absorber dye 4,5-dihydroxy-3-(6',8'-disulfo-2'-naptho azo)-2,7-napthalene disulfonic acid tetrasodium salt (ABS2).
- 2.530 g/m² of gelatin vehicle Layer 6: Mid Magenta
- 0.217 g/m² of green sensitized cubic grain silver bromoiodide (3.5% iodide) emulsion with an edge length of 0.080 μm and chemically sensitized with sulfur and gold sensitizers.
- 0.140 g/m² of magenta image-dye forming coupler M-1.
- 0 073 g/m² of masking coupler MC-2.
- 0.014 g/m² of magenta absorber dye ABS2.
- 0.727 g/m² of gelatin vehicle.

Layer 7: Fast Magenta
- 0.271 g/m² of green sensitized cubic grain silver bromoiodide (3.5% iodide) emulsion with an edge length of 0.115 μm and chemically sensitized with sulfur and gold sensitizers.
- 0.029 g/m² of magenta image-dye forming coupler M-1.
- 1.051 g/m² of magenta image-dye forming coupler M-2.
- 0.014 g/m² of masking coupler MC-2.
- 0 024 g/m² of magenta absorber dye ABS2.
- 0 727 g/m² of gelatin vehicle.

Layer 8: Interlayer
- 0.700 g/m² of gelatin vehicle.
- 0.269 g/m² of DOX-1
- 0.065 g/m² of yellow filter dye Y-1.

Layer 9: Slow Yellow
- (227 as Ag) 30% by weight blue sensitized cubic grain silver bromoiodide (3.5% iodide) emulsion.
- 0.115 micron grain size chemically sensitized with sulfur and gold chemical sensitizers and containing blue spectral sensitizers with 70% by weight blue sensitized cubic grain silver bromoiodide emulsion 0.091 micron grain size.
- (803) yellow image dye forming coupler
- Y-1. (22) magenta color masking coupler.
- (16) cyan coupler c-1
- (2313) gelatin vehicle Layer 10: Mid Yellow
- (162 as Ag) Blue sensitized cubic grain silver bromoiodide (3.5% iodide) emulsion. 0.145 micron grain size chemically sensitized with sulfur and gold chemical sensitzers and containing red spectral sensitizer.
- (222) yellow image-dye forming coupler Y-1.
- (11) magenta colored masking coupler
- (8) cyan coupler C-1.
- (699) gelatin vehicle.

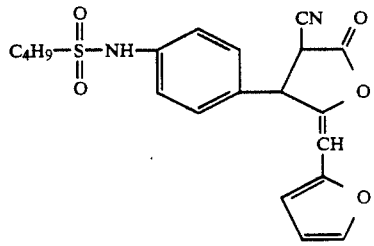

Y-1

-continued
MC-1
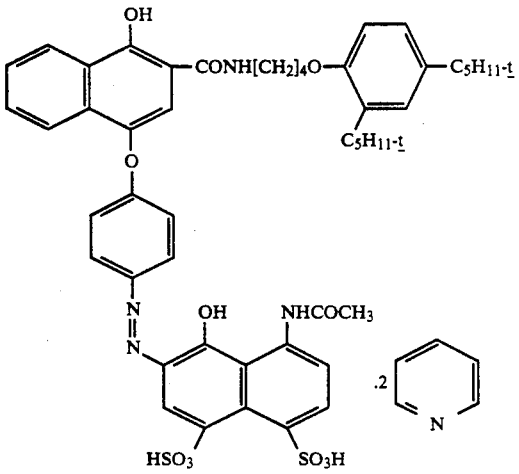
C-1
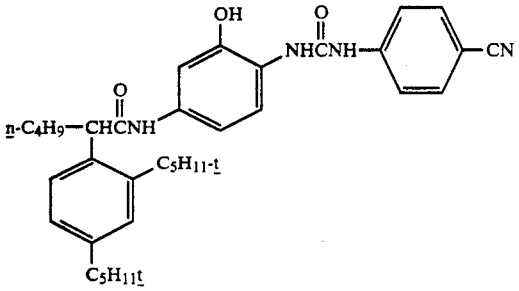
didodecylhydroquinone
DOX-1
M-1
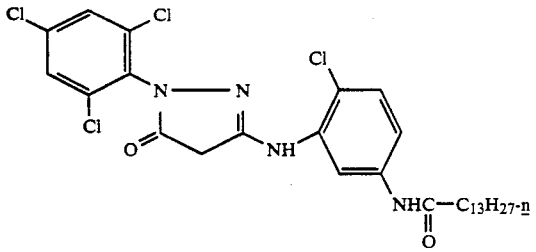
MC-2
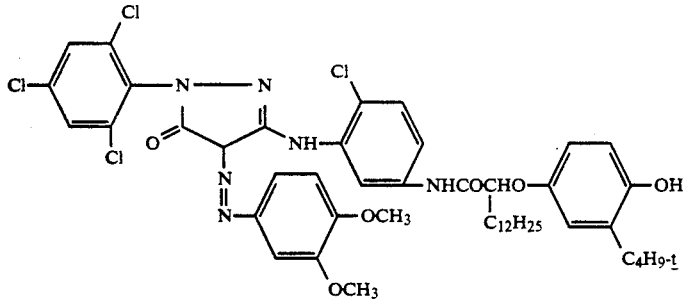
M-2
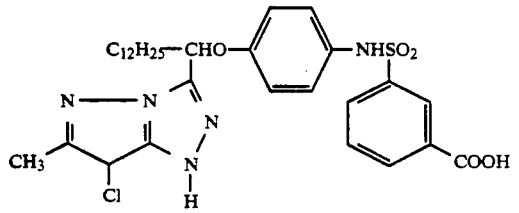
Bis[3-acetyl-1-(2,5-disulfophenyl)-2-pyrazolin-5-one-(4)]-pentamethine -continued oxonol, pentasodium salt

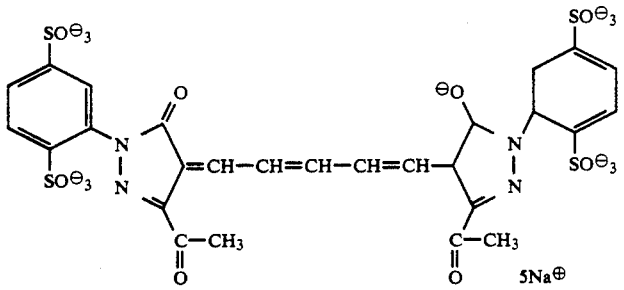

ABS1

The coatings were given MTF separation exposures. The separation exposures produced exposure in one light sensitive layer at a time. Separation exposures were used to eliminate the influence of interlayer interimage effects on acutance. The input exposure modulation was 60 percent. The strips were processed in the ECN-2 process. Resulting images were evaluated to generate standard red, green and blue MTF curves.

For purposes of quantifying acutance, two parameters were derived from the MTF (modulation Transfer Function) curves: these two parameters were used in order to characterize both the low frequency region and the high frequency region of the curves. The MTF at 12 cycles per mm , MTF(12), was chosen to be an appropriate descriptor of the low frequency response. The frequency at which the MTF equals 50 percent (F50) was chosen to be an appropriate descriptor of high frequency response. These parameters, MTF(12 ) and F50 were then modeled using standard linear regression techniques to provide responses as a function of the experimental parameters. Such a model provides estimations of the responses for combinations of parameters in addition to those actually tested.

There are two parts to the foregoing effort; the first is identification of the conditions required to ensure high red acutance, and the second is to identify the conditions required for closely matched acutance between the green and red MTF. Overlap between these two parts yields conditions which give both high red acutance and closely matched red and green acutance.

High Red Acutance

For the purposes of this example, high red acutance is defined to correspond to an MTF(12) of greater than 93 percent and and F50 of greater than 50 cycles. The linear regression for MTF(12) was used to generate the cyan dye levels required to achieve an MTF(12) of greater than 93 percent for 5 grain sizes and 5 fast blue silver laydowns. These are shown in Table 2.

TABLE 2

Red Absorber Dye Levels Required to Achieve MTF(12) Greater Than 93 Percent (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in microns, equivalent spherical diameter) | 0.21 | >85 | >93 | >100 | >98 | >95 |
| | 0.235 | >88 | >95 | >105 | >103 | >98 |
| | 0.26 | >88 | >98 | >108 | >108 | >103 |
| | 0.28 | >88 | >98 | >108 | >110 | >105 |
| | 0.30 | >88 | >98 | >108 | >110 | >108 |

Table 2 shows that the lower frequency of MTF goal, as quantified by MTF(12) greater than 93 percent, can be achieved with virtually all of the combinations of grain size and silver laydown in the Table, although the higher levels of silver laydown, and the larger grain sizes require some increase in absorber dye levels.

Similarly, the linear regression for F50 was used to generate cyan (that is, red absorber) dye levels required to achieve F50 of greater than 50 cycles/mm. That operation yields Table 3.

TABLE 3

Red Absorber Dye Levels Required to Achieve F50 Greater Than 50 cycles/mm (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in microns, equivalent spherical diameter) | 0.21 | all | all | >85 | >90 | >93 |
| | 0.235 | all | all | >93 | >100 | >103 |
| | 0.26 | all | all | >103 | >113 | >118 |
| | 0.28 | all | all | >113 | >131 | >136 |
| | 0.30 | all | all | >133 | n/a | n/a |

"all" indicates that all dye levels within the range of the experiment provided required performance (that is F50 > 50 cycles/mm)
n/a indicates that dye levels within the range of the experiment did not provide required performance Table 3 illustrates the immense effect of silver laydown levels on light scatter. At the lower silver laydowns, all dye levels within the range of the experiment can achieve an F50 of 50 cycles/mm. At the higher silver laydown levels and larger grain sizes, none of the dye levels within the range of the experiment can achieve an F50 of 50.

In order to satisfy the high red acutance requirement, both the conditions in Table 2 and the conditions in Table 3 should be satisfied concurrently. Thus the more restrictive condition from each table may be combined to yield another table which indicates the dye levels required to simultaneously achieve an MTF(12) greater than 93 percent and an F50 higher than 50 cycles/mm. The combination of those two tables is shown in Table 4.

TABLE 4

Red Absorber Dye Levels Required to Achieve MTF(12) Greater Than 93 Percent and an F50 Greater Than 50 cycles/mm (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in | 0.21 | >85 | >93 | >100 | >98 | >95 |
| | 0.235 | >88 | >95 | >105 | >103 | >103 |

TABLE 4-continued

Red Absorber Dye Levels Required to Achieve MTF(12) Greater Than 93 Percent and an F50 Greater Than 50 cycles/mm (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| microns, equivalent spherical diameter) | 0.26 | >88 | >98 | >108 | >113 | >118 |
| | 0.28 | >88 | >98 | >113 | >131 | >136 |
| | 0.30 | >88 | >98 | >133 | n/a | n/a |

n/a indicates that dye levels within the range of the experiment did not provide required performance (that is both MTF(12) greater than 93 percent and F50 greater than 50 cycles/mm)

Table 4 shows that low silver laydowns and small grain sizes require relatively low levels of red absorber dye in order to achieve the required performance of MTF(12) greater than 93 percent and F50 greater than 50 cycles/mm. High silver laydowns require more dye, and in the extreme of high silver laydowns and large grain sizes no amount of absorber dye within the experiment's range could produce the required acutance without suffering high red layer speed losses.

Table 5 shows the absorber dye levels required in order to achieve a close match (as defined in the previous paragraph) between the red and green curves at MTF(12).

TABLE 5

Red Absorber Dye Levels Required to Achieve Close MTF(12) Match Between Red and Green Curves (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in microns, equivalent spherical diameter) | 0.21 | >78 | >85 | >94 | >95 | >92 |
| | 0.235 | >78 | >85 | >93 | >95 | >92 |
| | 0.26 | >78 | >85 | >95 | >98 | >95 |
| | 0.28 | >82 | >91 | >101 | >104 | >103 |
| | 0.30 | >88 | >100 | >112 | >115 | >113 |

As seen before, Table 5 shows that higher dye levels are required to compensate for the scattering effects of large emulsion size and high silver laydowns.

Table 6 shows the dye levels required in order to achieve a close match, as defined previously, between the red and green curves at F50.

TABLE 6

Red Absorber Dye Levels Required to Achieve Close F50 Match Between Red and Green Curves (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in microns, equivalent spherical diameter) | 0.21 | 75*-85 | 78-93 | 80-90 | 83-93 | 85-95 |
| | 0.235 | 83-102 | 83-104 | 88-107 | 90-108 | 93-109 |
| | 0.26 | 79-104 | 85-110 | 93-118 | 98-118 | 103-123 |
| | 0.28 | 78-140 | 85-145 | >95 | >104 | >109 |
| | 0.30 | 75*-135 | 78-135 | 93-133 | >109 | >120 |

*indicates lower limit on dye level in model n/a indicates that dye levels within range of the experiment did not provide required performance

Closely Matched Acutance

The other part of this effort is to identify conditions that yield closely matched red and green acutance. In order to achieve that goal, linear regressions of the separation between the red and green MTF curves at MTF(12) and F50 were generated. These models allowed examination of the experimental conditions required in order to achieve a close curve match between the red and the green MTF curves in both the low frequency and the high frequency regions. For the purposes of this example, a close curve match is presumed to occur at low frequency if the red and green MTF curves at MTF(12) are separated by less than 5 percent. Similarly a high frequency close curve match is presumed to occur if the red and green MTF curves at F50 are separated by less than 6 cycles/mm.

Table 6 shows that the goal of closely matched MTF curves at F50 can be achieved only within a range of dye levels, particularly for the smaller emulsion. The upper limit on acceptable red absorber dye levels for the smaller grains occurs because the red acutance improves beyond the green acutance.

In order to provide a close curve match between the red and green curves the curves must closely match in both the low frequency and the high frequency region: the conditions listed both in Table 5 and Table must be satisfied concurrently. Thus the more restrictive condition from each table may be combined to yield another table which indicates the dye levels required to simultaneously achieve red and green MTF curves with MTF(12)'s separated by less than 5 percent and F50's separated by less than 6 cycles/mm. The combination of those two tables is shown in Table 7.

TABLE 7

Red Absorber Dye Levels Required to Achieve Close match Between Red and Green MTF Curves (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow Emulsion Size (in microns, equivalent | 0.21 | 78 > 85 | 85 > 93 | n/a | n/a | 92 > 95 |
| | 0.235 | 78-102 | 85-104 | 93-107 | 95-108 | 93-109 |
| | 0.26 | 79-104 | 85-110 | 95-118 | 98-118 | 103-123 |
| | 0.28 | 82-140 | 91-145 | >101 | >104 | >109 |

TABLE 7-continued

Red Absorber Dye Levels Required to Achieve Close match Between Red and Green MTF Curves (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| spherical diameter) | 0.30 | 88–135 | 100–135 | 112–133 | n/a | n/a |

*indicates lower limit on dye level in model
n/a indicates that dye levels within range of the experiment did not provide required performance

High Red Acutance and Closely Matched Green and Red Acutance

The overall goal of these efforts was to achieve a film which has both high red acutance and closely matched MTF curves. In order to achieve that goal, the conditions listed in both Tables 4 and Tables 7 must be satisfied concurrently. Thus the more restrictive condition from each table may be combined to yield another table which indicates the red absorber dye levels required to simultaneously achieve high red acutance and closely matched MTF curves. The combination of those two tables is shown in Table 8.

TABLE 8

Red Absorber Dye Levels Required to Simultaneously Achieve High Red Acutance and Close match Between Red and Green MTF Curves (absorber dye level of smb in mg/m2, ABS1 was at ½ smb level in each case)

| | | Fast Yellow Silver Laydown (mg/sq meter) | | | | |
|---|---|---|---|---|---|---|
| | | 151 | 192 | 237 | 282 | 323 |
| Fast Yellow | 0.21 | 85 | 93 | n/a | n/a | 95 |
| Emulsion Size | 0.235 | 88–102 | 95–104 | 105–107 | 103–108 | 103–109 |
| (in microns, | 0.26 | 88–104 | 98–110 | 108–118 | 113–118 | 118–123 |
| equivalent | 0.28 | 88–140 | 98–145 | >113 | >131 | >136 |
| spherical diameter) | 0.30 | 88–135 | 100–135 | 133 | n/a | n/a |

n/a indicates that dye levels within range of the experiment did not provide required performance The single numbers listed in Table 8 suggest that there is a very narrow range of red absorber dye level which satisfies all of the conditions required in order to achieve both high red acutance and closely matching red and green acutance.

EXAMPLE 2

This example describes a particular color photographic negative working duplicating element of the present invention. The element was constructed as described.

A cellulose acetate film support was coated with the following layers, in sequence (the coverages given are in milligrams per meter squared):

Layer 1—Slow Red (232 as Ag) red sensitized cubic grain silver bromoiodide (3.5 % iodide) gelatin emulsion. 0.042 micron grain size and chemically sensitized with sulfur and gold sensitizers.
(334) cyan dye forming coupler C-1.
(62) masking coupler MC-1.
(167) red absorber dyes (same dyes as in Example 1)
(3174) gelatin vehicle.

Layer 2—Mid Red (139 as Ag) red sensitized cubic grain silver bromoiodide (3.5% iodide) gelatin emulsion. 0.072 micron grain size chemically sensitized with sulfur and gold sensitizers.
(152) cyan image-dye forming coupler C-1.
(50) masking coupler MC-1.
(646) gelatin vehicle.

Layer 3—Fast Red (202 as Ag) 50% by weight red sensitized cubic grain silver bromoiodide (3.5% iodide) emulsion (0.136 micron grain size chemically sensitized with sulfur and gold sensitizers) with 50% by weight red sensitized cubic grain silver bromoiodide (3.5% iodide) emulsion (0.091 micron grain size chemically sensitized with sulfur and gold sensitizers).
(93) cyan image-dye forming coupler C-1.
(4.5) masking coupler MC-1
(780) gelatin vehicle.

Later 4—Interlayer (699) gelatin vehicle
(269) DOX-1

Layer 5—Slow Green (339 as Ag) Green sensitized cubic grain silver bromoiodide (3.5% iodide) gelatin emulsion. 0.056 micron grain size chemically sensitized with sulfur and gold chemical sensitizers.
(291) magenta image-dye forming coupler M-1.
(80) masking coupler MC-2.
(100) green absorber dye (same as in example 1).
(2582) gelating vehicle.

Layer 6—Mid Green (170 as Ag) Green sensitized cubic grain silver bromoiodide (3.5% iodide) emulsion. 0.080 micron grain size chemically sensitized with sulfur and gold chemical sensitizers.
(117) magenta image-dye forming coupler M-1.
(57) masking coupler MC-2.
(807) gelatin vehicle.

Layer 7—Fast Green (258 as Ag) Green sensitized cubic grain silver bromoiodide (3.5% iodide) emulsion. 0.115 micron grain size chemically sensitized with sulfur and gold chemical sensitizers.
(27) magenta image-dye forming coupler M-1.
(54) magenta image dye forming coupler M-2.
(14) masking coupler MC-2.
(753) gelatin vehicle.

Layer 8—Interlaver (699) gelatin vehicle.
(209) DOX-1
(81) blue filter dye.

Layer 9—Slow Blue (227 as Ag) 30% by weight blue sensitized cubic grain silver bromoiodide (3.5% iodide) emulsion. 0.115 micron grain size chemically sensitized with sulfur and gold chemical sensitizers and containing blue spectral sensitizer with 70% by weight blue sensitized cubic grain silver bromoiodide emulsion 0.091 micron grain size.
(803) yellow image-dye forming coupler Y-1
(22) magenta color masking coupler MC-3.
(16) cyan coupler C-1
(2313) gelatin vehicle.

Layer 10—Mid Blue (162 as Ag) Blue sensitized cubic grain silver bromoiodide (3.5% iodide) emulsion. 0.145 micron grain size chemically sensitized with sulfur and gold chemical sensitizers and containing red spectral sensitizer.
(222) yellow image-dye forming coupler Y-1.
(11) magenta colored masking coupler MC-3.
(8) cyan coupler C-1
(699) gelatin vehicle.

Layer 11—Fast Blue (226 as Ag) Blue sensitized cubic grain silver bromoiodide (3.5% iodide) emulsion. 0.197 micron grain size chemically sensitized with sulfur and gold chemical sensitizers and containing red spectral sensitizer.
(184) yellow image-dye forming coupler Y-1.
(12) magenta colored masking coupler MC-3.
(753) gelatin vehicle.

Layer 12—Blue Interlayer (915) gelatin vehicle.
(108) Lippmann silver.

Layer 13—Overcoat Layer (753) gelatin and matting agent.

The Y-1, MC-1, C-1, DOX-1, M-1, MC-2, M-2 and MC-3 are identified as follows:

M-1

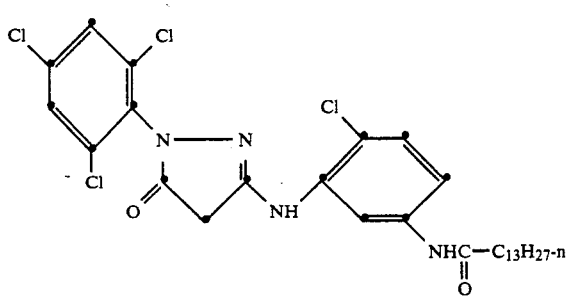

MC-2

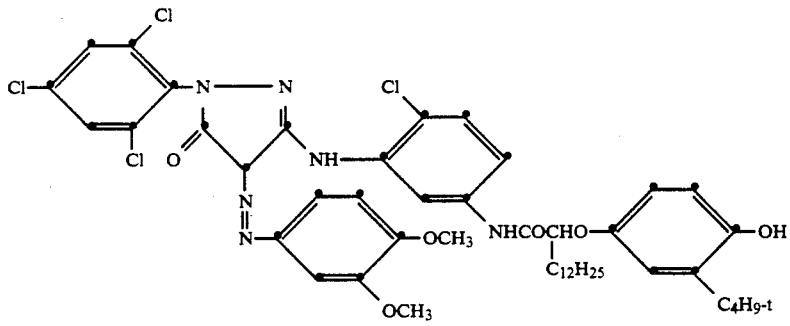

M-2

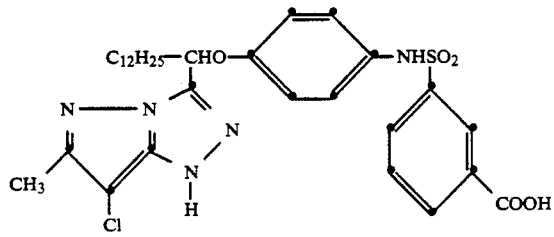

-continued

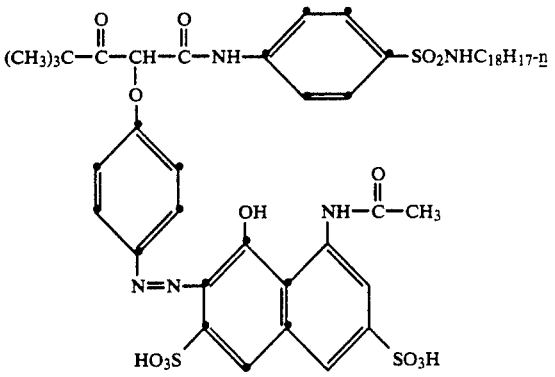

MC-3

The Y-1, MC-1, C-1, DOX-1, M-1, MC-2, M-2, and MC-3 are identified as follows:

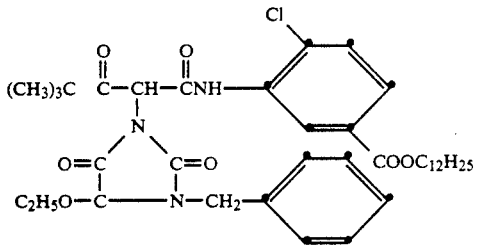

Y-1

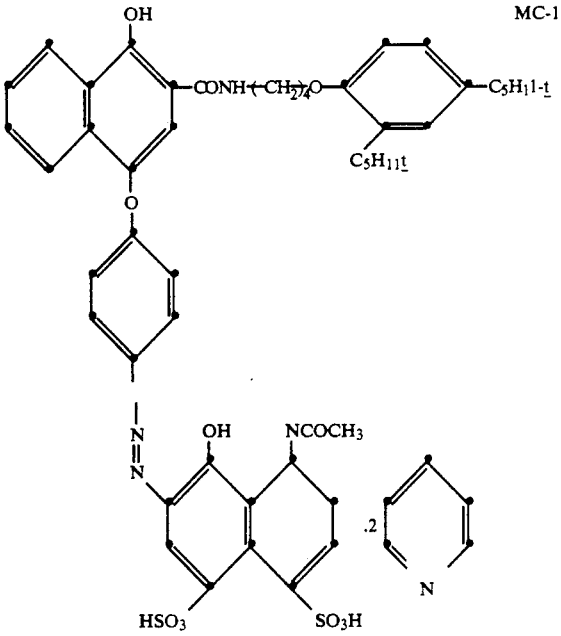

MC-1

-continued

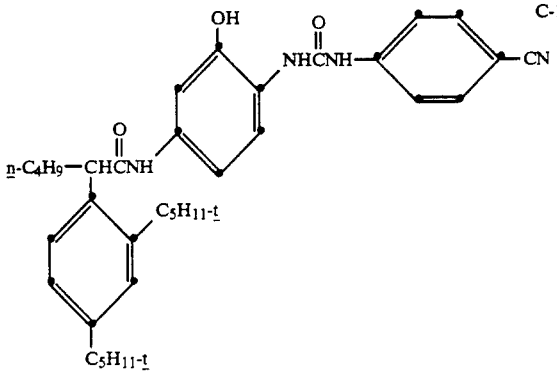

C-1

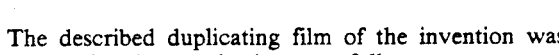

didodecylhydroquinone DOX-1

The described duplicating film of the invention was used in forming a color image as follows:

An original camera negative motion picture film (ON-1) (original color negative motion picture film) which was EI 100 35 mm EXR Color Negative Film, No. 5248, (trademark of and commercially available from Eastman Kodak Co., U.S.A.) was imagewise exposed to a conventional Macbeth Color Rendition Chart containing colors of the visible spectrum. The Macbeth Color Rendition Chart is commercially available from Macbeth, a division of Kollmorgen Corporation, 2441 N. Calbert St., Baltimore, Md., U.S.A. and is a trademark of Kollmorgen Corporation, U.S.A. The exposure provided a developable latent image in the ON-1 film. The exposed ON-1 film was then processed in a commercial Eastman Color Negative-2 development process (ECN-2 process commercially available from Eastman Kodak Co., U.S.A.). This ECN-2 process and the compositions for this process are described in, for example, "Manual for Processing Eastman Color Film—H-24", available from Eastman Kodak Company, Rochester, N.Y., U.S.A.

The described intermediate film (IF-1) of the invention was then imagewise exposed to light using the described processed original color negative film (ON-1). A latent image was formed in the intermediate film based on the image in the original color negative film. The imagewise exposed intermediate film was then processed in the same way using the same process (ECN-2) as described for the original color negative film.

The resulting processed intermediate film (IF-1) was then used to form a master positive film (MP-1) image.

This master positive film was then printed again onto a second sample of the intermediate film of the invention (IF-2) as described above to provide a duplicate negative. The exposure steps and processing were essentially the same in each step as described for the exposure and processing of the original color negative film (ON-1).

Finally the duplicate negative (IF-2) (intermediate film of the invention) was printed onto Eastman Color Print Film (ECP-1) (commercially available from Eastman Kodak Co., U.S.A.) forming a release print. The exposure and processing of the Eastman Color Print film (ECP-1) was as commercially used for the ECP-2B process commercially available from Eastman Kodak Co. (The ECP-2B process is described in the above "Manual for Processing Eastman Color Films—H-24" available from Eastman Kodak Co., U.S.A.)

The resulting duplicating film has a red layer with an MTF(12) greater than 93% and within 5% of the green MTF(12), and also had an F50 exceeding 50 cycles/mm and within 6 cycles/mm of the green record F50.

The invention has been described in detail with particular reference to preferred embodiments thereof, but it will be understood that variations and modifications can be effected within the spirit and scope of the invention.

We claim:

1. A color photographic silver halide duplicating element comprising a support bearing, in order from the support, at least one red-sensitive photographic silver halide emulsion layer comprising at least one cyan image-dye forming coupler that is capable upon exposure and processing of forming a cyan image dye that absorbs in the range of the original image; at least one green-sensitive photographic silver halide emulsion layer comprising at least one magenta image-dye forming coupler that is capable, upon exposure and processing, of forming a magenta image dye that absorbs in the range of the original image; and at least one blue-sensitive photographic silver halide emulsion layer comprising at least one yellow image-dye forming coupler that is capable upon exposure and processing of forming a yellow image dye that absorbs in the range of the original image; wherein at least said one blue sensitive photographic layer comprises a fastest blue sensitive layer wherein:

the silver halide particles in the fastest blue sensitive layer have an equivalent spherical diameter no greater than 0.3 microns, while in the remainder of the layers the silver halide particles have an equivalent spherical diameter of no greater than 0.23 microns;

the silver level in the fastest blue sensitive layer is no greater than 30 mg/square foot; and a sufficient red absorber is present so that the red record MTF(12) (Modulation Transfer Function at 12 cycles/mm) is at least 95% of the green record MTF(12) and the red record F50, (frequency at which the MTF equals 50%) is no more than 6 cycles/mm less than the green record F50.

2. A color photographic element according to claim 1 wherein the red record MTF(12) is within 5% of the green record MTF(12) and the red record F50 is within 6 cycles/mm of the green record F50.

3. A color photographic element according to claim 1 wherein the red record MTF(12) is within 3% of the green record MTF(12) and the red record F50 is within 3 cycles/mm of the green record F50.

4. A color photographic element according to claim 1 wherein the silver level in the fastest blue sensitive layer is no greater than 15 mg/square foot.

5. A color photographic element according to claim 1 wherein silver halide of the emulsion comprises cubic silver halide particles.

6. A color photographic element according to claim 1 wherein the silver halide of emulsion consists essentially of non-tabular silver halide particles.

7. A color photographic element according to claim 1 wherein silver halide of the emulsion consists essentially of cubic silver halide particles.

8. A color photographic element according to claim 1 wherein the red record has an MTF(12) of at least 90% and an F50 of at least 45 cycles/mm.

9. A color photographic element according to claim 1 in which the duplicating element is a negative working duplicating element.

10. A color photographic element according to claim 3 in which the duplicating element is a negative working duplicating element.

11. A color photographic element according to claim 7 in which the duplicating element is a negative working duplicating element.

12. A color photographic element according to claim 8 in which the duplicating element is a negative working duplicating element.

13. A color photographic element according to claim 1 wherein the red record has an MTF(12) of at least 93% and an F50 of at least 50 cycles/mm.

14. A color photographic element according to claim 13 wherein the element is a negative working duplicating element.

* * * * *

UNITED STATES PATENT AND TRADEMARK OFFICE

CERTIFICATE OF CORRECTION

PATENT NO. : 5,283,164

DATED : Feb. 1, 1994

INVENTOR(S) : David E. Fenton, et al

It is certified that error appears in the above-indentified patent and that said Letters Patent is hereby corrected as shown below:

On title page, Abstract, last line, "6/mm? should read --6 cycles/mm--.

Signed and Sealed this

Twenty-sixth Day of July, 1994

Bruce Lehman

*Attest:*

BRUCE LEHMAN

*Attesting Officer*

*Commissioner of Patents and Trademarks*